US006409218B1

(12) United States Patent
Wemmel et al.

(10) Patent No.: US 6,409,218 B1
(45) Date of Patent: Jun. 25, 2002

(54) THEFT PROTECTION MARKING AND MARKING METHOD

(75) Inventors: Hermann Wemmel, Gifhorn; Gustav Wagenmann, Wolfsburg, both of (DE)

(73) Assignee: Volkswagen AG (DE)

( * ) Notice: Subject to any disclaimer, the term of this patent is extended or adjusted under 35 U.S.C. 154(b) by 28 days.

(21) Appl. No.: 09/586,112

(22) Filed: Jun. 2, 2000

Related U.S. Application Data

(63) Continuation of application No. PCT/EP98/07848, filed on Dec. 3, 1998.

(30) Foreign Application Priority Data

Dec. 9, 1997 (DE) ..... 197 54 404

(51) Int. Cl.[7] ..... B42D 15/00
(52) U.S. Cl. ..... 283/81; 283/101
(58) Field of Search ..... 156/247, 278; 283/81, 79, 80, 101, 105, 107, 109, 111; 428/915

(56) References Cited

U.S. PATENT DOCUMENTS 4,204,706 A * 5/1980 Blum et al. ..... 283/81
4,976,456 A * 12/1990 Jack ..... 283/81 X
5,360,628 A 11/1994 Butland
5,514,860 A 5/1996 Berson
5,824,397 A 10/1998 Koops et al.
6,047,991 A * 4/2000 Finke et al. ..... 283/81
6,149,204 A * 11/2000 Casper ..... 283/81

FOREIGN PATENT DOCUMENTS

| | | |
|---|---|---|
| DE | 4109787 | 12/1981 |
| DE | 4030045 | 3/1992 |
| DE | 4300544 | 7/1994 |
| DE | 19642262 | 3/1997 |
| GB | 2141665 | 1/1985 |
| WO | 9509089 | 4/1995 |

* cited by examiner

*Primary Examiner*—William Fridie, Jr.
(74) *Attorney, Agent, or Firm*—Baker Botts LLP

(57) ABSTRACT

Visually observable and visually non-observable theft protection markings are used for marking equipment, the non-observable marking being made, for example, by UV paints which can only be observed under UV light. For this purpose, a label portraying a company logo is applied to an article which is to be marked. The label has openings such that the UV paint reproduces the logo on the surface of the article in an unobservable manner when the outer and inner edges of the label are painted over with the UV paint. The logo remains as a non-marked surface portion in the invisible UV film after the label is removed. The invention is suited for protectively marking equipment against theft.

8 Claims, 2 Drawing Sheets

THEFT PROTECTION MARKING AND MARKING METHOD

REFERENCE TO RELATED APPLICATION

This application is a continuation of International Application No. PCT/EP98/07848 filed Dec. 3, 1998.

BACKGROUND OF THE INVENTION

This invention relates to methods for visually non-observable marking of objects and to theft protection markings for objects.

Various types of equipment, such as industrial and production equipment, tools, electrical equipment, office machines and communication equipment, are increasingly being individually marked by owners to permit identification of the equipment among discovered stolen goods. Such markings are divided into two categories: i.e., (1) visually non-observable markings and (2) visually observable markings. For the first category of marking, UV pens are customarily used, making it possible to apply an individual marking with a very difficult to remove, visually non-observable UV ink, for example by writing the owner's name on the object. Such UV markers are commercially available as security pens.

For the second category, a label is applied to the object or the object itself is permanently labeled, for example by an engraving device or soldering iron. Combinations of such markings are also possible, for example by using special UV or laser paints, i.e., paints that show a particular color when viewed in UV light or laser light, or which show a different color under UV light than when they are viewed in normal light. Such paints can be used to create innocuous markings that are not removed by a thief or receiver of stolen goods as long as their presence is not known. A disadvantage of the visually observable markings is that every effort is made to remove the marking after a theft, for instance by filing it off. A disadvantage of the visually non-observable markings is that achieving reliable traceability of ownership is resource-intensive since an entire name must always be applied and furthermore, in the case of visually non-observable markings used alone, there is the risk that potential thieves will be tempted to steal the object since they see no marking on it.

SUMMARY OF THE INVENTION

Accordingly, it is an object of the invention to provide a theft protection marking method and a theft protection marking which overcome disadvantages of the prior art.

Another object of the invention is to provide a theft protection marking and method for marking equipment reliably in a simple manner.

These and other objects of the invention are attained by applying a label having an edge configuration to an object and applying a marking which is detectable only with special devices along an edge of the label on the object.

Thus, in accordance with the invention, an object is provided with a theft protection marking that is not visually observable. One example for providing such a theft protection marking is a UV marker which only forms a visible color under UV light. Other invisible marking detection methods are also possible. However, application of the invisible marking is not done freehand or through the use of stencils, as has been customary. Instead, a label is first affixed to the object, and the invisible marking is then applied around the edge of the label. This causes the pattern of the invisible marking on the object to have a precisely defined geometric shape and, with an endless variety of special label shapes, it is nearly impossible for another labeler to have the same geometric shape for his markings.

The use of a label instead of a stencil also achieves the result that invisible marking is accomplished significantly faster and that a separate stencil need not be stocked for providing a marking. The stocking of labels is relatively simple, and moreover is generally done by individuals who label equipment, for example in the form of an inventory label. The use of a label has the further advantage that the label can be left on the object as a visually observable marking, so that one thus obtains a combination of a visually observable marking and a visually non-observable marking. Also, presence of the visible marking by itself achieves a certain theft-deterrent effect.

Labels that can be adhesively attached are especially suitable, since they are the easiest to apply. However, other attachment methods, such as rivets, for example, are also possible. Self-adhesive labels are especially appropriate, and stickers which are difficult to remove are advantageously used.

The UV paints common today that make visually non-observable marking possible, i.e., transparent paints, are designed so that they are not removable with common solvents and, moreover, penetrate somewhat into many objects so that even a light filing does not cause the marking to be lost.

However, the method in accordance with the invention is also suitable for providing a completely invisible marking by using a label that is relatively easy to pull off. In this case, the label functions as a stencil for the marking and is then removed after the marking is applied. In particular, both methods can be combined in that a label used as a stencil for invisible marking is left on the object after marking in one place after, and in another place on the same object the label is removed after the application of an invisible marking. As a result, a thief who detects the invisible marking on the label which is not removed, for whatever reason, and files off the marking may leave the second invisible marking untouched.

It is particularly advantageous if the label has an edge configuration that differs from a simple circle, square, rectangle or triangle, or other very simple geometric shape, including one with rounded comers. This effectively guarantees individuality in the marking. In particular, the label can also have an opening providing an interior edge so that an especially unique marking is possible in combination with the outer edge label configuration.

It is particularly advantageous for the label to take the form of a logo, for example a company logo. This makes it possible to invisibly mark the object with the company logo by UV marking around the edge contours of the logo, including any interior edge contours. This means that the logo marks the object in a manner visible to the unaided eye when it remains on the object, whereas the logo is preserved as a marking on the object that is invisible to the naked eye after the logo label is removed from the object. The logo can then be detected immediately, for example with a UV lamp, which makes it very simple for security authorities such as police to trace the ownership of a discovered object.

The marking in accordance with the invention includes the features described for the method, either individually or in combination.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
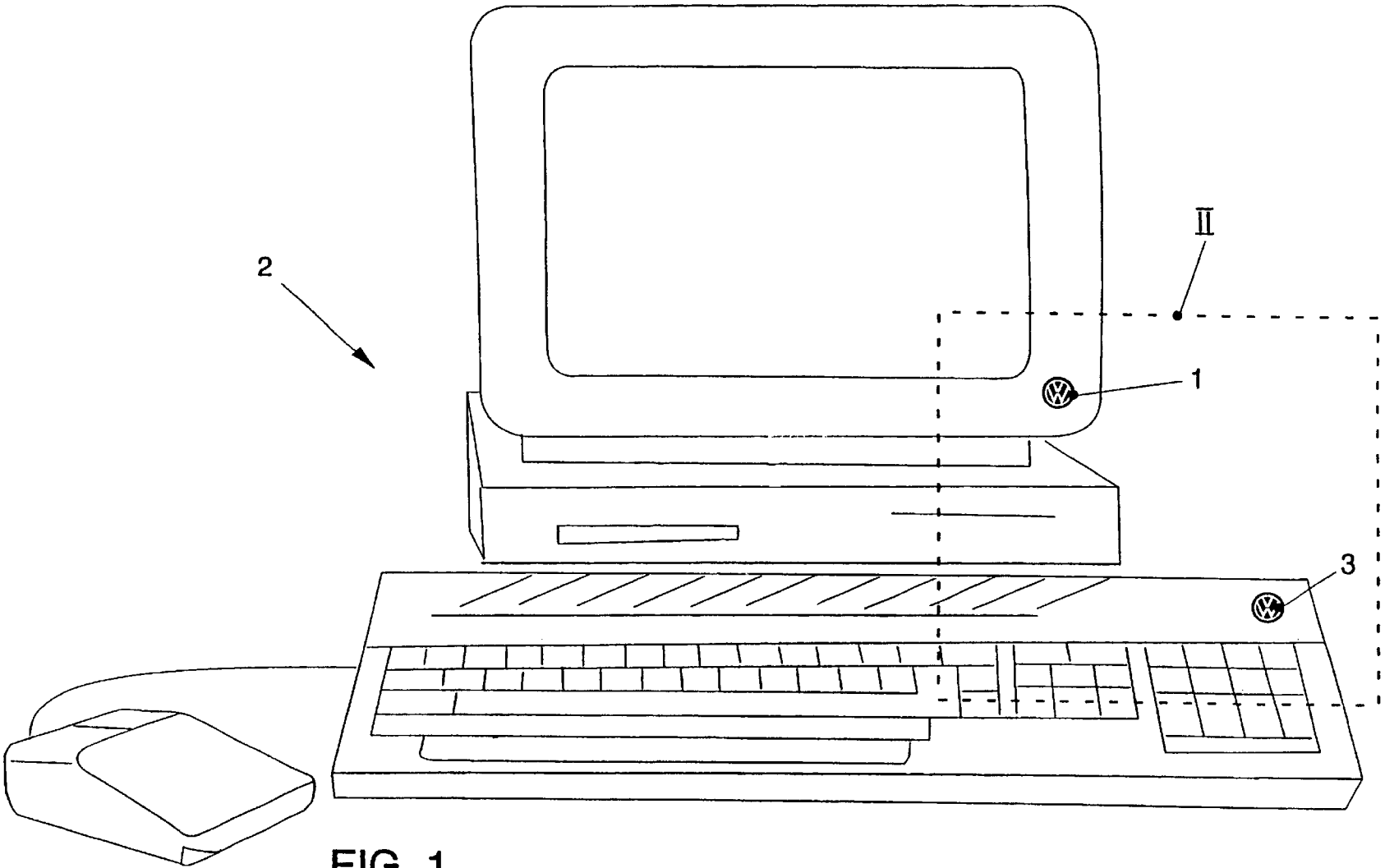
FIG. 1 is a schematic illustration of a computer with theft protection markings according to the invention.

In the typical embodiment of the invention shown in FIG. 1, two company logos 1 and 3 are applied to a computer 2. The logo application is accomplished by removing a protective film from the adhesive back of logo labels, applying the logo labels to the computer 2 and pressing the logo labels against the computer, for example by a transfer film. If a transfer film is used, it is subsequently removed. Then, to provide theft protection markings, a security pen is used to paint over the entire logo labels. It is not necessary for this painting to be done carefully along the edge contours of the logo labels. Instead, one can simply use the security pen to paint the edge region, or to swab over the entire logo labels, thus covering the inner and outer edge contours. In this way, the security pen marks the surface of the object in the vicinity of the edge of the logo labels 1 and/or 3, and may also mark the surfaces of the logo labels. Marking over the logo labels is not a problem since the security pen forms a film that essentially is not observable to the eye.

Figure 2:
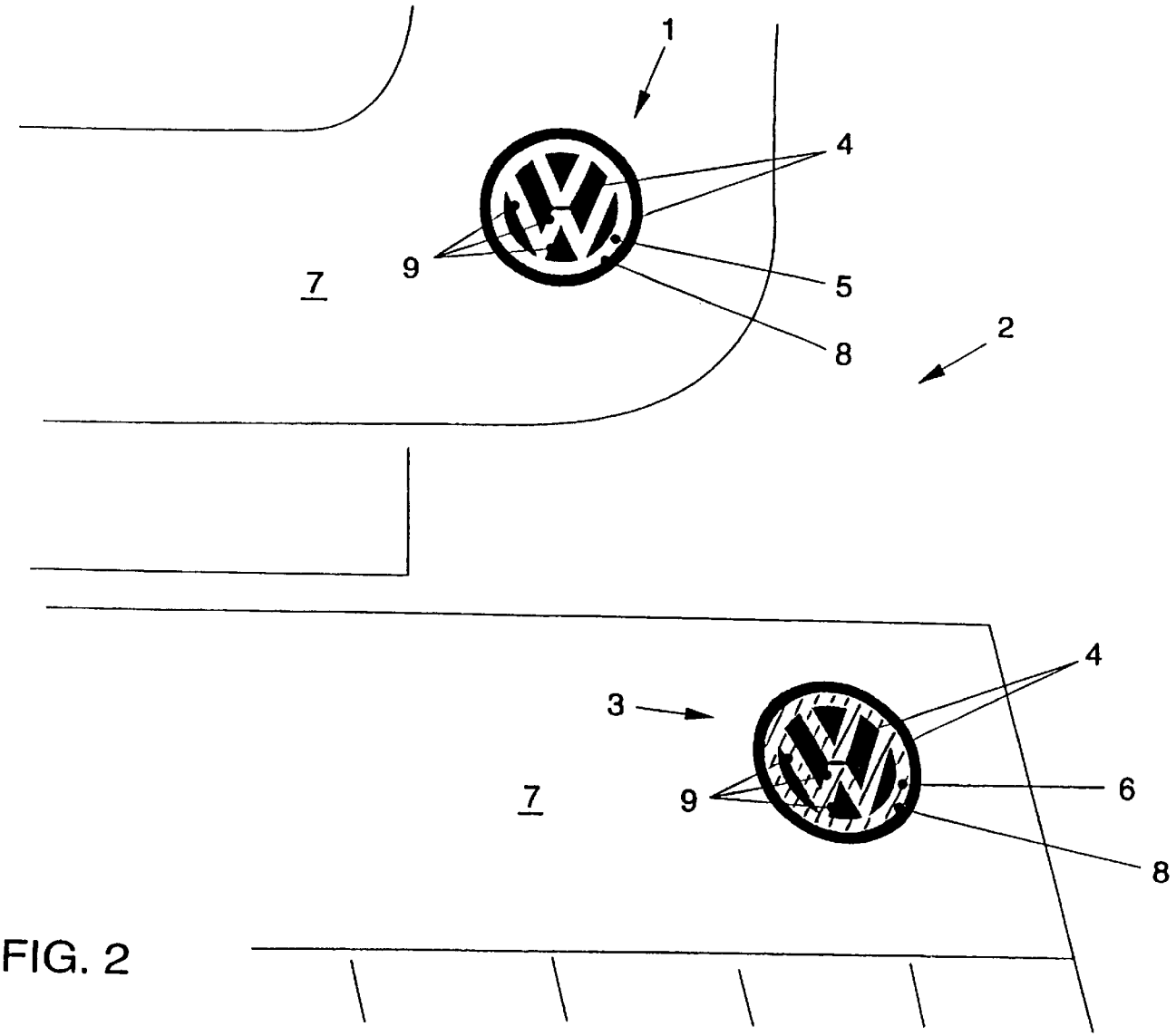
FIG. 2 is an enlarged detail of the markings shown in FIG. 1 after removal of a label from one of the markings.

As shown enlarged in FIG. 2, the security pen forms a theft protection marking in the form of an invisible film 4 in the region inside of and around the outside of the edge contours of the logo 1 and/or the logo 3, which is shown dark in the drawings but in reality can only be detected or recognized using a special device. FIG. 2 shows, in greater detail, two theft protection marking possibilities. The first marking possibility is shown with the logo 1 in which the logo label has been removed after painting with the security pen, so that the entire logo 1 as seen in FIG. 1 is visible only with the use of a special device. The film regions 4 are detectible only under UV light, and the original surface 7 is then visible in the regions 5 between the film regions 4. Only under UV light does the logo I appear as illustrated in FIG. 2. In contrast, the logo 3 still contains the logo label 6, which covers the surface 7 and is thus visually detectible. The security film 4, is also applied around the inside and outside edge contours of the label 6 but only the label 6 is visible as a logo to an observer in the normal case with no special devices. Under UV light, however, everything becomes colored if the film 4 was also painted over the logo. If this label 6 were then to be removed, the same condition described with respect to the logo 1 would automatically be achieved. In each case the use of a familiar or traceable company logo as a theft protection marking aids in identifying the owner of the object after it has been recovered.

Thus, in accordance with the invention, one example of a theft protection marking is a label 6 that represents a company logo 3 which is adhesively attached to an object 2 to be marked and is covered with a transparent film of UV responsive ink. The label 6 has cutouts so that the UV responsive transparent film 4 produces the logo invisibly on the surface 7 of the object 2 when it is painted over the outer and inner edge contours 8 and 9 of the label 6. Even after the label 6 is removed, the logo remains as an unmarked surface 5 with the invisible UV film 4 as a theft protection marking as described with respect to the logo 1.

Accordingly, the invention is suitable for the secure labeling of equipment for theft protection.

Although the invention has been described herein with reference to specific embodiments, many modifications and variations therein will readily occur to those skilled in the art. Accordingly, all such variations and modifications are included within the intended scope of the invention.

We claim:

1. A theft protection marking for an object comprising a film of a marking material applied over a label on an object, the film being invisible and only detectable with a special device, the film having an edge contour adjacent and corresponding to an edge contour of a label applied to the object, with essentially no marking material beneath the label, to provide an invisible outline of the label on the object.

2. A theft protection marking in accordance with claim 1 including the label applied to the object.

3. A theft protection marking in accordance with claim 1 wherein the label has been removed from the object.

4. A theft protection marking in accordance with claim 2 including a second film of marking material applied to the object at a different location and which is only detectable with a special device, the second film of marking material having an edge contour corresponding to the edge contour of a label applied to the object and remaining after the label has been removed from the object.

5. A theft protection marking in accordance with claim 1 wherein the label has an edge contour that differs from that of a circle, square, rectangle or triangle.

6. A theft protection marking in accordance with claim 5 wherein the edge contour has a reliably identifiable configuration.

7. A theft protection marking in accordance with claim 1 wherein the label has an inner edge contour in addition to an outer edge contour.

8. A theft protection marking in accordance with claim 1 wherein the label contains a logo.

* * * * *